United States Patent [19]

Goldberger et al.

[11] 4,313,573

[45] Feb. 2, 1982

[54] TWO STAGE COMMINUTION

[75] Inventors: William M. Goldberger; Harold M. Epstein; Bhupendra K. Parekh, all of Columbus, Ohio

[73] Assignee: Battelle Development Corporation, Columbus, Ohio

[21] Appl. No.: 124,480

[22] Filed: Feb. 25, 1980

[51] Int. Cl.[3] ..... B02C 19/18

[52] U.S. Cl. ..... 241/1; 241/29

[58] Field of Search ..... 299/14; 241/1, 152 A, 241/152 R, 29

[56] References Cited

U.S. PATENT DOCUMENTS 3,181,799 5/1965 Wurzburg et al. ..... 241/1
4,253,704 3/1981 Levin ..... 241/1 X

FOREIGN PATENT DOCUMENTS 576410 10/1977 U.S.S.R. ..... 241/1
594998 2/1978 U.S.S.R. ..... 241/1

OTHER PUBLICATIONS

Andres, U. T. S. "Liberation of Apatite Nepheline Ore Comminuted by Pentrating Elect. Discharges", Int'l. Jnl. of Mineral Processing, No. 4, 1977, pp. 33–38.

Yigit E. et al. "Selective Breakage in Electrohydraulic Comminution", Trans. Instn. Chem. Engrs., vol. 47, 1969, pp. T332–334.

Carley–Macavly, K. W. et al., "Energy Consumption in Electrohydraulic Crushing", Trans. Instn. Chem. Engrs., vol. 44, 1966, pp. T394–404.

*Primary Examiner*—Mark Rosenbaum

*Attorney, Agent, or Firm*—Barry S. Bissell

[57] ABSTRACT

A two-step method for separating mineral grains from their ores is practised by first applying a shock discharge directly through the ore sample producing shock waves emanating from along the discharge path and reflected shock waves (tension waves) from grain boundaries and other discontinuities in the ore, such tension waves resulting in tensile stresses in the ore greater than the strength of the boundary or discontinuity whereby to gross spall the sample generally along the discharge path and to microfracture the region near the discharge path. The second step comprises comminuting the microfractured ore by impact or non-impact means to further reduce the ore generally along microfractures wherein considerably less energy is expended in the second step than would be required to reduce the ore to the same condition without the first step. A second non-impact step is preferably the application of acoustic energy to the microfractured region of the ore resulting in enlargement of microfractures and subsequent spalling of these microfractured regions.

17 Claims, 2 Drawing Figures

TWO STAGE COMMINUTION

BACKGROUND OF THE INVENTION

The mineral industry consumes vast amounts of the total energy generated in the United States. And ore comminution by mechanical means consumes some 50% of the total energy required for mineral extraction. It has also been found that only about 1% of such energy of comminution is expended to generate new surfaces; the remainder is lost in frictional losses and heat. Thus a non-impact means of reduction has the potential for significant savings in energy. Capital costs may also be reduced.

Several nonmechanical methods have been suggested in the past but have been rejected for various reasons. The Snyder process, for example, comprised charging a coarse ore into a pressure chamber, pressurizing with a gas, and activating a quick-opening (15 millisecond) discharge valve which subjected the particles to a variety of impulse phenomena that caused reduction. Energy reduction in pilot plant studies did not justify further commercialization.

Primary reduction of large rocks by thermal stressing has been tried in the past (for example see U.S. Pat. No. 3,460,766, Sarapuu) but electrohydraulic crushing has received more attention. The latter technique involves the generation of a hydraulic shock wave of explosive intensity by a pulse discharge through water. It is, in truth, the nonmechanical compressive force which reduces the rock.

In the *International Journal of Mineral Processing*, volume 4, pages 33–38 (1977), Andres discusses a method for penetrating electrical discharge. He does not apply the discharge directly to the rock but again applies it to the liquid surrounding the rock resulting in attenuation of the electrical discharge energy. Two articles in *Trans. Instn. Chem. Engrs.* by Carley-MacCauly, et al. and Yigit, et al. (volume 44, page T395, 1966, and volume 47, page T332, 1969) discuss a similar method for fracturing brittle materials by means of a spark discharge through water.

In applying an electrical discharge through a nonconductor there are three regimes based on the duration of the discharge or pulse width. These regimes depend on separate mechanisms which yield significantly differing results.

The longest pulse width in the 0.1 second and longer range is in a thermal regime where the electrical discharge results in gross heating (exemplified by the Sarapuu patent). The intermediate impulse regime is characterized by pulse widths in the 100 microsecond to 100 millisecond range and results in a compressional force being applied over a period of time and fracture such as would be caused by mechanical impact.

The third regime comprises the shock discharge which is the subject of this invention. It occurs when the pulse width is in about the $10^{-3}-10^{-7}$ second range. The speed of the pressure wave away from the discharge exceeds the speed of sound thereby building up a pressure pulse through the sample. The rarefaction portion of this pressure pulse and reflected waves actually fracture the rock in tension along weak planes in the sample, generally along grain boundaries and mineralization veins.

SUMMARY OF THE INVENTION

It is an object of the invention to provide a method for the secondary comminution of ores.

It is further an object to provide a two-step method for ore comminution wherein the ore is fractured along grain boundaries of mineral phases.

It is also an object to provide such a comminution method having a non-impact first step which results in energy savings over mechanical impact means.

It is further an object to provide a comminution method which is entirely non-impact.

In accordance with the objectives, the invention comprises a two step method of first applying an electric field directly to an ore sample wherein the field is at least equal to the pulse breakdown field for the ore, and inducing a short duration electrical discharge directly through the ore between electrodes in contact with the ore for a time sufficient to cause shock waves in the ore sample emanating from the discharge path. The duration or pulse width is preferably on the order of about $10^{-3}-10^{-7}$ seconds. The shock wave must be reflected in the ore with sufficient force to exceed the tensile strength of a phase in the region of the reflected wave path such that the ore surrounding the discharge path will be microcracked. The second step comprises applying energy to the microfractured region of the ore to enlarge microfractures and cause spalling and removal of portions of the microfractured regions. This may be applied by conventional mechanical means or preferably with non-impact means such as an acoustic transducer.

The method may be further improved by applying the electric field in two components, the first component being short in time but with a magnitude in excess of the pulse breakdown field for the ore and therefore sufficient to initiate the discharge pulse and a second component which comprises the remainder of the duration of the field at a reduced magnitude below the pulse breakdown field of the ore which merely sustains the electrical discharge pulse. This is accomplished with a series injection apparatus to be later described and results in a further reduction in energy requirements.

The second step preferably comprises applying acoustic energy to the microfractured region. The acoustic wave is preferably in the ultrasonic region, i.e. in excess of about 20 khz. The acoustic energy may be applied continuously while the shock discharge is applied intermittently or a succession of alternating shock wave and acoustic wave cycles may be used.

DETAILED DESCRIPTION

Figure 1:
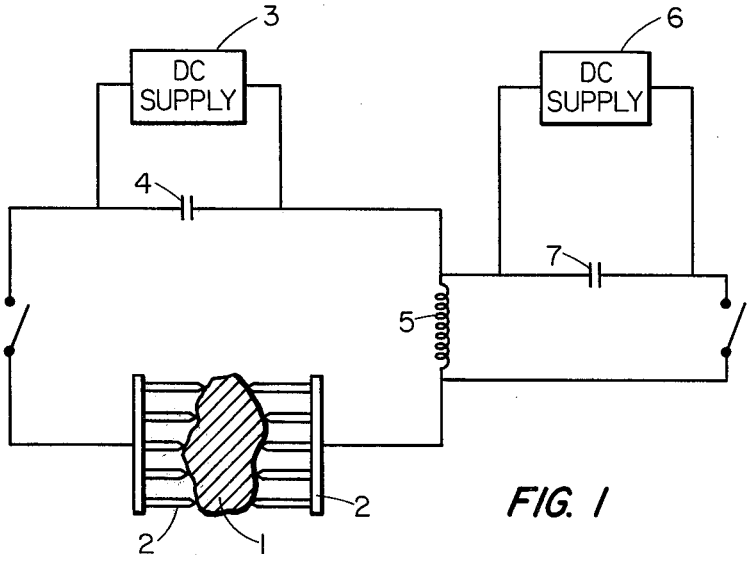
FIG. 1 is a schematic representation of apparatus for applying an electrical discharge to an ore sample.

According to the invention a shock discharge is applied directly through an ore sample to cause gross fracture and also microfractures and microstrains in the ore region near the discharge path. The microfractured and microstrained region is then broken apart by a second stage reduction, preferably by the cavitation effect of an acoustic wave applied to the region through a liquid medium. The acoustic energy may be continuously applied during a period of intermittent electrical discharges or each electrical discharge may be followed by a short pulse of acoustic energy.

The electrical discharge is applied through known electrical circuitry and electrodes which are in contact with generally opposing sides of the rock sample. An insulating medium, such as distilled water, oil, vacuum, and the like, surrounds the sample and electrodes to prevent arcing between electrodes around the rock sample. In producing the shock discharge, an electric field in excess of the pulse breakdown field for the particular ore material is applied to the rock sample. The value of the pulse breakdown field may be obtained from standard reference tables or empirically. Some handbooks give only the D.C. breakdown field which is generally on the order of one-half to one-third the pulse breakdown field.

The pulse breakdown field is applied for a time sufficient to induce a short duration electrical discharge directly through the ore which causes shock waves in the material having sufficient peak pressure to create a reflected or tensile wave with force in excess of the tensile strength of a surrounding mineral phase in the shock region. The result is the fracturing of the ore along the discharge path and the microfracturing of the ore regions near the discharge path.

The electrical discharge tends to follow the path of least electrical resistance through the ore. Happily, this path is commonly along mineralization grain boundaries such that the mineral may be selectively removed from the remaining ore by the following sequence. The electrical discharge or pulse passes through the low resistivity path, commonly but not necessarily along the mineralization vein at ore grain boundaries, and causes vaporization of volitles in the immediate vicinity. The path is generally a line at the initiation area but broadens to a plane as it passes through the ore sample. The vaporization along this discharge path may cause the explosive fracture and spalling of large fragments exposing new surfaces containing the mineral.

Primarily, each rapid vaporization site emits an acoustic shock which penetrates the ore in all directions from the site. Some ore fragments may be spalled by the impulse of an internally-reflected, "trapped" shock wave from the vaporization sites but the real benefit of the discharge induced shock waves is the microfracturing of the ore in the vicinity of the discharge pulse path. The shock wave travels from the vaporization site on the discharge path through the material in excess of the speed of sound such that a compressional pressure is built up as it passes through the ore. When the shock waves meet a grain boundary, mineralization vein or other discontinuity in acoustic impedence, they are reflected thereby causing microfracturing of the ore due to tensile stresses in the rarefaction portion of such reflected tensional waves. The reflected waves attenuate rapidly through the solid depending on the initial energy and the material, but for example may cause microfracturing in a region of a quartz sample a few hundred microns thick. Even if the reflected wave attenuates below the level necessary to be able to microcrack the ore, it may still have enough energy to microstrain a region in the ore which would make its subsequent fracture much easier.

The basis for effective shock fracturing is the maximization of the peak pressure of the compressional shock waves (and thereby the reflected tensional waves) through the ore and the maximization of internal reflections of the waves at grain boundaries or other discontinuities. The reflected waves may produce a net tension at a distance of at least one-half of the reflected pulse width from the reflecting discontinuity. It is beneficial to use this to match the pressure pulse to the average grain size of the ore in order to attempt to maximize tension at a grain boundary.

Quantitatively, the peak pressure (P) of a shock wave emanating from the vapor/solid interface of a vaporization site along a discharge path is a function of the electric field (E), the distance between electrodes (d), the inductance (L) and capacitance (C) in the circuit (which define the pulse width) and the material density, $\rho$. The relationship is given by:

$$P \cong 0.4\left(\frac{\rho E}{LCd}\right)^{\frac{1}{2}}$$

The parameters are selected such that the peak pressure of the shock wave is sufficient to produce reflected (tension) waves which produce stress in excess of the tensile strength of at least one of the ore phases near the discharge path. Under these conditions, the pulse width must generally be in the range $10^{-3}$ to $10^{-7}$ seconds.

FIG. 1 shows a schematic of apparatus which may be used to apply the electrical discharge directly to the ore in the present invention. The ore fragment 1 is generally in the range of less than 4 inches in diameter since this invention is most useful in secondary comminution. Electrodes 2 are in direct contact with the ore and may make point contact at an array of locations. The external circuitry consists of standard elements for causing electrical discharge including, in one loop, power supply 3 and capacitor 4 along with a switch. This loop would be sufficient to practice the invention but an additional loop comprising inductor 5, capacitor 7, power supply 6 and a switch may be used to further reduce the energy consumption of the process. The pulse breakdown field for the ore material need be exceeded only for a short time to initiate discharge and thereafter a much lower sustaining field can be applied during the pulse. The level of the sustaining field may be chosen at a convenient level considering that the amount of energy causing fracture is $\frac{1}{2}$ $CV^2$. Therefore, in the schematic shown, the pulse breakdown voltage would be applied instantaneously through the right loop (containing inductor 5) which is essentially a high voltage generator. The remainder of the pulse would be applied at lower field by the left loop (containing capacitor 4). This is what is known as a series injection whereby, for example, an initial field of 20 kv/cm could be applied by the inductor loop and thereafter a 2 kv/cm field from the left loop could maintain the pulse.

The electrical discharge apparatus discussed above comprises the first stage of the present invention. An electrical discharge applied according to the invention may fracture the sample along the discharge path but in any event results in the production of the shock waves which cause microfracturing and microstraining in the region immediately surrounding the discharge path. This weakens the region traversed by the reflected shock waves and makes it more easily fractured by the second stage of the present invention.

The second stage may comprise conventional mechanical crushing using any convenient impact means such as crushers, hammers, rollers, mills and the like. The energy used with such impact methods is considerably less than would be necessary without the primary stage.

Preferably, however, the second stage of the invention comprises reduction of the microcracked ore from the first stage by non-impact means. Such non-impact means are, for example, electrical discharge in the steady or impulse regime, laser impact (such as shown in U.S. Pat. No. 3,850,698 which is incorporated herein by reference, or with microwaves.

The preferred non-impact method for reduction of the microfractured ore is through application of acoustic energy to the submerged, microfractured ore wherein cavitation is used to enlarge existing microfractures and induce fractures in the microstrained regions.

Figure 2:
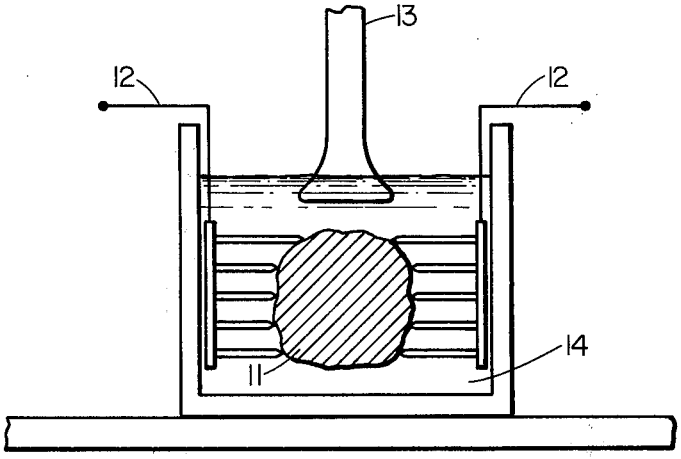
FIG. 2 is a schematic representation of electrical discharge and acoustic apparatus for practicing the invention.

FIG. 2 shows a schematic of both discharge and acoustic apparatus for practising the invention. Ore sample 11 is placed in an insulating medium 14 which in this case is distilled water. Electrodes 12 are shown in place directly in contact with the ore sample but without the external circuitry which could be that shown in FIG. 1. An acoustic horn or other radiating surface is located near the sample and within the liquid medium 14. The horn may be driven at sonic frequencies which would result in vibration and collisions between loose particles. Preferably, however, the horn is driven at ultrasonic frequencies, typically between about 20 khz and 50 khz. The acoustic energy must be great enough to cause cavitation in the liquid near the surface of the ore and to cause enlargement of microfractures in the ore and the "tearing away" of microfractured fragments. Applying acoustic energy to cause cavitation in a liquid is well known in the art but as far as we know has never been used in a two step method for ore comminution.

The sonic energy may be applied continuously while intermittent pulse discharges are applied to the sample. Alternatively, the process may comprise alternately shocking the ore and sonically breaking off microfractured segments in repetitive cycles. The radiating surface need not be at the same location as the discharge device and in fact could be made in the shape of a cylinder and used as both a radiating surface and a conduit to move the ore slurry to another location after shocking.

Example of the Preferred Embodiment

The types of ores which are fractured are not critical. It is preferred to use ores which have weak mineralization veins or binders relative to the bulk material so that the fracturing may be selective to these materials. Molybdenite, fluorspar and chalcopyrite have been investigated but others are equally preferred.

EXAMPLE 1

Cylindrical samples of molybdenite ore 1.2 cm in diameter by 1.0 cm high were comminuted in the following manner. A discharge apparatus such as shown in FIG. 1 without the series injection was used to apply a shock to the molybdenite cylinders. The samples and electrodes were submerged in transformer oil and up to about 20 kv was applied to the samples. A long pulse of duration about $10^{-3}$ seconds was used to shock the sample because the $FeS_2$ is very weak. One shock was used and the cylinders broke into several fragments. The fragments were analyzed for molybdenum and iron with the following typical results.

| Mesh Size | Weight, g | Weight Percent | Assay, percent $MoS_2$ | Assay, percent $FeS_2$ | Distribution, percent $MoS_2$ | Distribution, percent $FeS_2$ |
|---|---|---|---|---|---|---|
| +4 | 5.08 | 84.1 | 0.89 | 19.4 | 97.0 | 77.7 |
| 4 × 8 | 0.92 | 15.2 | 0.15 | 27.4 | 2.8 | 19.8 |
| −8 | 0.035 | 0.7 | 0.26 | 72.8 | 0.2 | 2.5 |
| Total | 6.035 | 100.0 | 0.771[a] | 20.98[a] | 100.0 | 100.0 |

[a]Calculated head sample assay.

Although these data are limited, they do indicate that electrical fracturing can result in selective liberation of sulfide minerals included in quartz. The reason that pyrite rather than molybdenite is selectively removed is not known. A possible explanation is that molybdenite is one of the softer minerals (1–1.5 on the Mohs scale) whereas pyrite is far more crystalline and brittle (6–6.5 Mohs hardness—slightly below quartz). It is reasonable to expect that fracture along veinlets and grains would tend to selectively liberate the harder, more brittle minerals.

Fracture results were investigated with the aid of before and after discharge micrographs of the cylindrical specimens. The discharge experiments showed that fractures develop in the vicinity of adjacent molybdenite streaks. Fractures were also seen to coincide with pyrite mineralization within the vicinity of pyrite grains contained within a silicate matrix. Substantial microfracturing occurred along the smooth grain boundaries of the quartz host-material in the immediate vicinity of the major fractures developed within the sample. Observable microcracking appeared to extend away from the discharge path into the ore to a depth of about 100 microns.

EXAMPLE 2

Cylindrical samples shocked as described in Example 1 were slurried in water and held in a large container. An ultrasonic horn such as shown in FIG. 2 was introduced in the liquid and driven at about 20 khz at sufficient power to cause cavitation in the liquid. The liquid quickly became cloudy as fragments of the microfractured regions of the shocked samples were spalled from the samples by the cavitation near sample surfaces.

We claim:

1. A method for the two stage comminution of ore which comprises (A) applying directly to an ore sample an electric field at least equal to the pulse breakdown field of the ore and inducing a short duration electrical discharge through the ore sample and between electrodes in contact with the ore sample for a time sufficient to cause shock waves in the ore having peak pressures sufficiently high to produce reflected waves which induce tensile stresses in the ore in excess of the tensile strength of at least one phase in the path of the reflected waves such that such phase is microfractured, and (B) applying secondary energy to the microfractured region of the ore to enlarge the microfractures and remove portions of such microfractured ore from the remaining ore sample.

2. The method of claim 1 for mineral separation from its ore wherein the shock wave peak pressures are sufficient to produce reflected waves which induce tensile stresses in excess of the tensile strength of the mineral to be separated.

3. The method of claim 1 wherein the secondary energy is mechanical, thermal, acoustic or light energy.

4. The method of claim 1 wherein the secondary energy is mechanical and is provided by crushers, mills, hammers or rollers.

5. The method of claim 1 for the two stage non-impact comminution of ores wherein the secondary energy comprises acoustic energy.

6. The method of claim 5 wherein the acoustic energy is provided by a transducer which comprises submerging the ore sample and the transducer in liquid and applying sufficient acoustic energy to cause cavitation near the ore sample surface.

7. The method as in claim 1 or 5 wherein the electric field is applied in first and second stages wherein the first stage is a field in excess of the pulse breakdown field and the second stage is less than the pulse breakdown field for the ore.

8. The method of claim 5 wherein the shock discharge is between about $10^{-3}$ and $10^{-7}$ seconds.

9. The method of claim 8 wherein the shock discharge and the acoustic energy are applied when the sample is submerged in water.

10. The method as in claim 5 wherein the acoustic energy is in the range of about 20 khz to about 50 khz.

11. The method of claim 5 wherein the acoustic energy is continuously applied to the ore sample and the shock discharge is applied intermittently.

12. The method of claim 5 wherein the shock discharge and the acoustic energy are applied alternately.

13. A method for the non-impact separation of a mineral from its ore which comprises (A) submerging an ore sample in an electrically insulating liquid, (B) applying directly to the ore sample an electric field at least equal to the pulse breakdown field of the ore, (C) inducing a short duration electrical discharge through the ore sample and between electrodes in contact with the ore sample along a discharge path for a time sufficient to cause gross fracture along the discharge path and to cause shock waves emanating from vaporization sites along the electrical discharge path in the ore, said shock waves having peak pressures sufficient to produce tensile stresses in the ore in excess of the tensile strength of a mineral phase adjacent the discharge path such that such mineral phase is microfractured by the tensile stresses, and (D) applying acoustic energy in the insulating liquid to the microfractured mineral phase to enlarge the microfractures and remove portions of the microfractured phase from the remaining ore sample by cavitation in the liquid adjacent thereto.

14. The method as in claim 13 wherein the electric field is applied in first and second stages wherein the first stage is a field in excess of the pulse breakdown field and the second stage is less than the pulse breakdown field for the ore.

15. The method as in claim 13 wherein the pulse width of the shock discharge is between about $10^{-3}$ and $10^{-7}$ seconds.

16. The method of claim 13 wherein the acoustic energy is continuously applied to the ore sample and the shock discharge is applied intermittently.

17. The method of claim 13 wherein the shock discharge and the acoustic energy are applied alternately.

* * * * *